United States Patent [19]

Otsuka

[11] Patent Number: 4,867,186

[45] Date of Patent: Sep. 19, 1989

[54] CHLORO-FLUORO-CARBON LIQUID JETTING IMMERSION CLEANING APPARATUS

[76] Inventor: Shigeo Otsuka, 3-3-32, Kigawa-Higashi, Yodogawa, Osaka, Japan

[21] Appl. No.: 231,901

[22] Filed: Aug. 15, 1988

[51] Int. Cl.[4] ..... B08B 3/02

[52] U.S. Cl. ..... 134/111; 134/166 R; 134/135; 134/184; 134/200

[58] Field of Search ..... 134/94, 99, 104, 111, 134/166 R, 168 R, 169 A, 174, 186, 198, 60, 135, 152, 162, 170, 184, 201, 99

[56] References Cited

U.S. PATENT DOCUMENTS

| | | | |
|---|---|---|---|
| 843,423 | 2/1907 | Weymar | 134/145 |
| 1,209,263 | 12/1916 | Clauss | 134/145 X |
| 2,651,311 | 9/1953 | Rule | 134/89 |
| 3,447,544 | 6/1969 | De Vergara | 134/111 X |
| 3,481,868 | 12/1969 | Gilwood et al. | 210/534 X |
| 4,051,858 | 10/1977 | Mele | 134/111 X |
| 4,179,307 | 12/1979 | Cau et al. | 134/148 X |
| 4,196,019 | 4/1980 | Kohler | 134/111 X |
| 4,226,548 | 10/1980 | Reith | 134/111 X |
| 4,464,256 | 8/1984 | Plourde | 134/111 X |
| 4,784,169 | 11/1988 | Striedieck | 134/111 |

*Primary Examiner*—Frankie L. Stinson

*Attorney, Agent, or Firm*—Moonray Kojima

[57] ABSTRACT

This invention relates to a cleaning apparatus for cleaning workpieces such as semiconductors and other electronic devices, or automobile parts, hydraulic implement parts and other die-cast products. A workpiece is completely immersed in chloro-fluoro-carbon (R113) liquid acting as cleaning liquid stored in a cleaning tank, and the cleaning liquid is caused to jet out of injection nozzles under pressure against portions of the workpiece to be cleaned. This immersion cleaning effectively removes cutting powder, abrasive materials and other such substances persistently clinging to the workpiece. This apparatus is capable of an efficient cleaning treatment which is achieved by reducing consumption and loss of the cleaning liquid.

2 Claims, 5 Drawing Sheets

CHLORO-FLUORO-CARBON LIQUID JETTING IMMERSION CLEANING APPARATUS

SUMMARY OF THE INVENTION

This invention relates to a cleaning apparatus for cleaning workpieces such as semiconductors and other electronic devices, or automobile parts, hydraulic implement parts and other die-cast products. A workpiece is completely immersed in chloro-fluoro-carbon (R113) liquid acting as cleaning liquid stored in a cleaning tank, and the cleaning liquid is caused to jet out of injection nozzles under pressure against portions of the workpiece to be cleaned. This immersion cleaning effectively removes cutting powder, abrasive materials and other such substances persistently clinging to the workpiece. This apparatus is capable of an efficient cleaning treatment which is achieved by reducing consumption and loss of the cleaning liquid.

BACKGROUND OF THE INVENTION

In a known apparatus for cleaning workpieces with chloro-fluoro-carbon liquid, a workpiece is placed in a cleaning position centrally of a cleaning chamber having chloro-fluoro-carbon vapor dispersed therein. Then chloro-fluoro-carbon liquid is sprayed to the inside or tapped holes of the workpiece from injection nozzles arranged laterally of the cleaning position. The jets of chloro-fluoro-carbon liquid act to remove cutting powder, an abrasive material, water-soluble cutting oil and the like produced or used in a cutting process and clinging to the inside or tapped holes of the workpiece.

However, since the workpiece is cleaned in the chloro-fluoro-carbon vapor centrally of the cleaning chamber according to the above cleaning apparatus, part of chloro-fluoro-carbon liquid jetting out of the injection nozzles and having a low boiling point is vaporized and dispersed in the cleaning chamber. It is therefore difficult to concentrate chloro-fluoro-carbon liquid on the portions of the workpiece to be cleaned, which results in a reduced cleaning effect of the chloro-fluoro-carbon liquid jets.

The known apparatus requires a large amount of chloro-fluoro-carbon liquid in order to compensate for the reduced cleaning effect. And considerable consumption and loss of chloro-fluoro-carbon liquid occur during a cleaning operation. These aspects give rise to a problem of high running cost.

OBJECTS OF THE INVENTION

A primary object of this invention is to provide a chloro-fluoro-carbon liquid jetting immersion cleaning apparatus capable of reliably removing cutting power, an abrasive material and the like persistently clinging to a workpiece by jetting chloro-fluoro-carbon liquid to the workpiece placed in the chloro-fluoro-carbon liquid stored in a cleaning tank, and yet reducing consumption and loss of the chloro-fluoro-carbon liquid.

Another object of this invention is to provide a chloro-fluoro-carbon liquid jetting immersion cleaning apparatus capable of an efficient cleaning operation, which is achieved by allowing chloro-fluoro-carbon liquid to permeate into fine interstices between a workpiece and cutting powder or the like, thereby to degrease an abrasive material and the like clinging to workpiece surfaces and place such materials in a readily separable state, applying impacts and vibrations to the cutting powder and the like by means of chloro-fluoro-carbon liquid jets to separate and remove such clinging materials, and discharging the separated cutting powder and other materials with the chloro-fluoro-carbon liquid jets outwardly of the workpiece.

A further object of the invention is to provide a chloro-fluoro-carbon liquid jetting immersion cleaning apparatus having a special construction for transferring impurities settling to the bottom of a cleaning tank to a collecting tank in a constant amount by means of jet streams for injection nozzles, thereby to prevent clogging of a filter and to maintain a cleaning liquid in the cleaning tank in a clean state all the time.

Other objects of this invention will be apparent from the following description of a preferred embodiment.

BRIEF DESCRIPTION OF THE DRAWINGS

The drawings show an embodiment of this invention, in which.

DESCRIPTION OF THE PREFERRED EMBODIMENT

An embodiment of this invention will be described in detail hereinafter with reference to the drawings.

Figure 1:
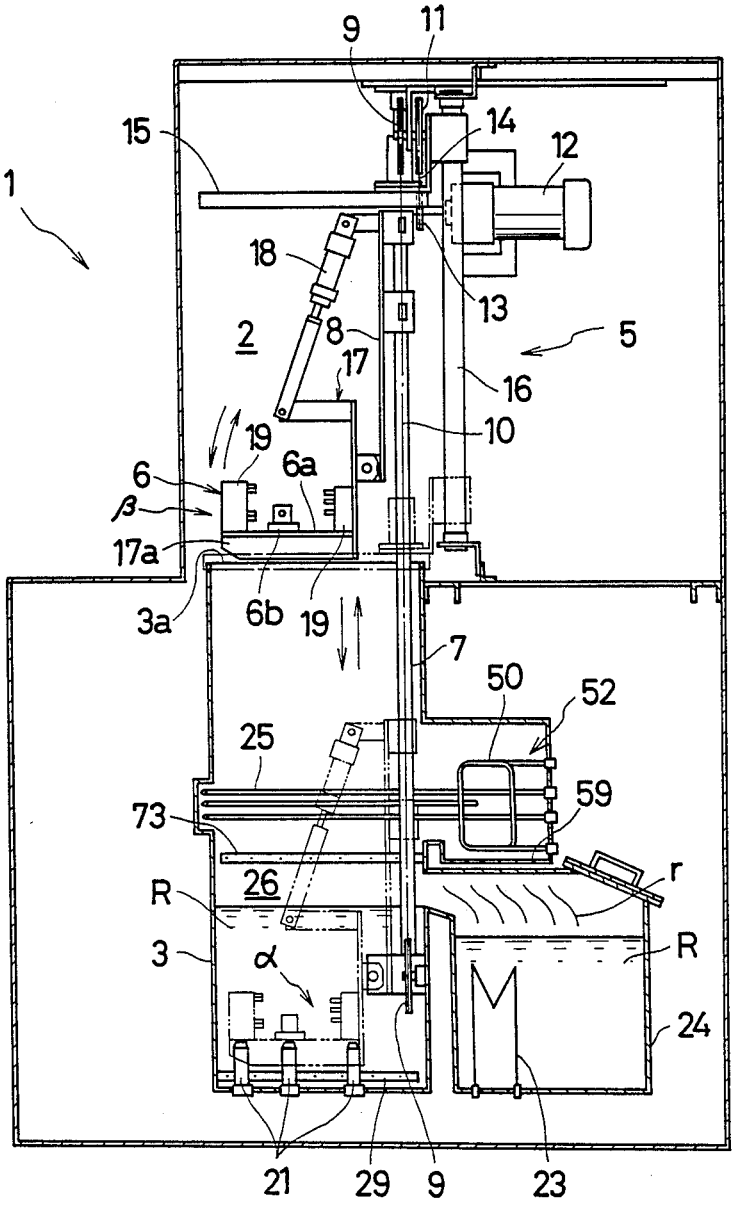
FIG. 1 is a side view of an interior construction of a chloro-fluoro-carbon liquid jetting immersion cleaning apparatus.

Referring to FIG. 1, a chloro-fluoro-carbon liquid jetting immersion cleaning apparatus 1 comprises a gastight cleaning chamber 2 housing a cleaning tank 3 having an open top 3*a*. The cleaning tank 3 stores an appropriate amount of chloro-fluoro-carbon liquid R (R113, namely 1,1,2-trichloro-1,2,2-trifluoro-ethane) acting as cleaning liquid. A workpiece 4 is set to a support deck 6 of a workpiece feeding device 5 and is completely immersed in the cleaning liquid R. A cleaning operation is carried out by jetting the cleaning liquid R to portions of the workpiece 4 to be cleaned as immersed in the cleaning liquid R.

The workpiece feeding device 5 includes a slider 8 vertically slidably connected to two guide rods 7 extending vertically along inside walls of the cleaning tank 3.

The slider 8 is securely connected to an end of a raising and lowering chain 10 wound around an upper and a lower sprockets 9 supported by a ceiling of the cleaning chamber 2 and a wall of the cleaning tank 3 submerged in the cleaning liquid R, respectively. The upper sprocket 9 and a driven sprocket 11 are fixed to a common shaft. A drive motor 12 having a reduction gearing is fixed to a lateral position. A drive chain 14 is wound around a drive sprocket 13 of the drive motor 12. The drive motor 12 is operable under control to drive the raising and lowering chain 10 backward and forward, whereby the support deck 6 fixed to the slider 8 is movable between a workpiece cleaning position $\alpha$ completely immersed in the cleaning liquid R stored in the cleaning tank 3 and a workpiece setting position $\beta$ above the cleaning tank 3.

A lid 15 is slidably connected to the guide rods 7 upwardly of the slider 8. The lid 15 is vertically movable by a lid driving air cylinder 16 erected at a position above the cleaning tank 3, between a lower, sealing position for engaging the open top 3*a* of the cleaning tank 3 (a phantom-line position in FIG. 1) and an upper, opening position for allowing movement of the slider 8 (a solid-line position in FIG. 1).

The support deck 6 is securely mounted on a lower floor 17*a* of a U-shaped table 17 supported at a lower front position of the slider 8. The support deck 6 is maintained in a horizontal posture by a vibrating air cylinder 18 pivotally connected to a top end of the table 17.

Figure 2:
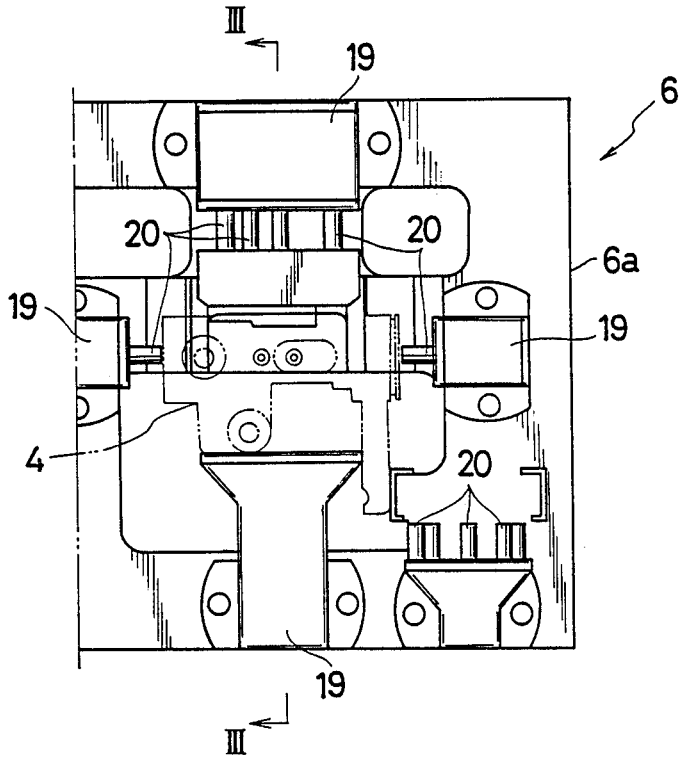
FIG. 2 is an enlarged plan view of a support deck.
Figure 3:
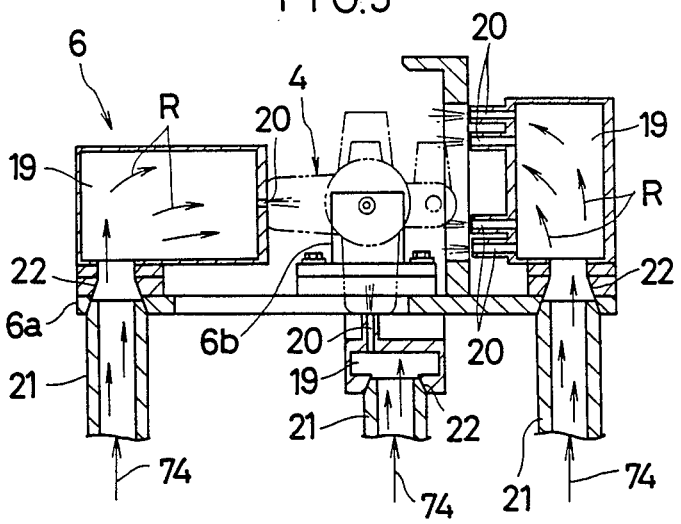
FIG. 3 is a section taken on line III—III of FIG. 2.

Referring to FIGS. 2 and 3, the workpiece 4 is held in position, as shown in phantom lines, by a jig 6*b* on a base 6*a* of the support deck 6. The support deck 6 includes liquid holders 19 fixed thereto in opposed relationship with respective sides of the workpiece 4. Each liquid holder 19 defined a plurality of injection nozzles 20 directed toward the workpiece 4.

Figure 5:
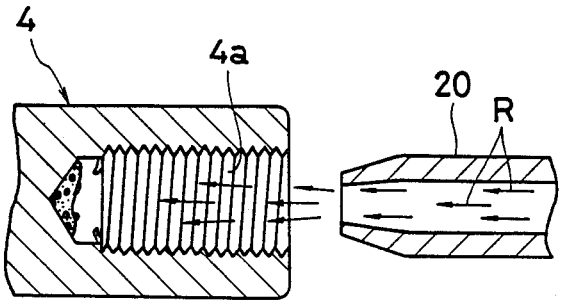
FIGS. 5 through 7 are explanatory views showing how a workpiece is cleaned, respectively.

These injection nozzles 20 are arranged so as to correspond in position and number to parts of the workpiece 4 to be cleaned such as bores or tapped holes 4*a* (FIG. 5) formed in the workpiece 4. As shown in FIG. 5, each nozzle 20 has a distal end located close to each part of the workpiece 4 to be cleaned, with its jetting direction set to the center of that part.

As shown in FIG. 3, when the support deck 6 is lowered to the workpiece cleaning position $\alpha$ in the cleaning tank 3, the injection nozzles 20 are placed in communication with liquid supply ports 21 extending upward from the bottom of the cleaning tank 3. This communication is provided through coupling ports 22 defined in the support deck 6 and communicating with the liquid holders 19.

Reverting to FIG. 1, the cleaning apparatus 1 further comprises a distilling tank 24 disposed behind the cleaning tank 3 and including a heater 23 in the bottom thereof.

The heater 23 heats the cleaning liquid R in the distilling tank 24, and resulting vapor of chloro-fluoro-carbon $\gamma$ is supplied to a vapor layer 26 formed between the surface of the cleaning liquid R stored in the cleaning tank 3 and a cooling jacket 25 arranged on a lateral inside wall of the cleaning tank 3 above the cleaning liquid R.

Figure 4:
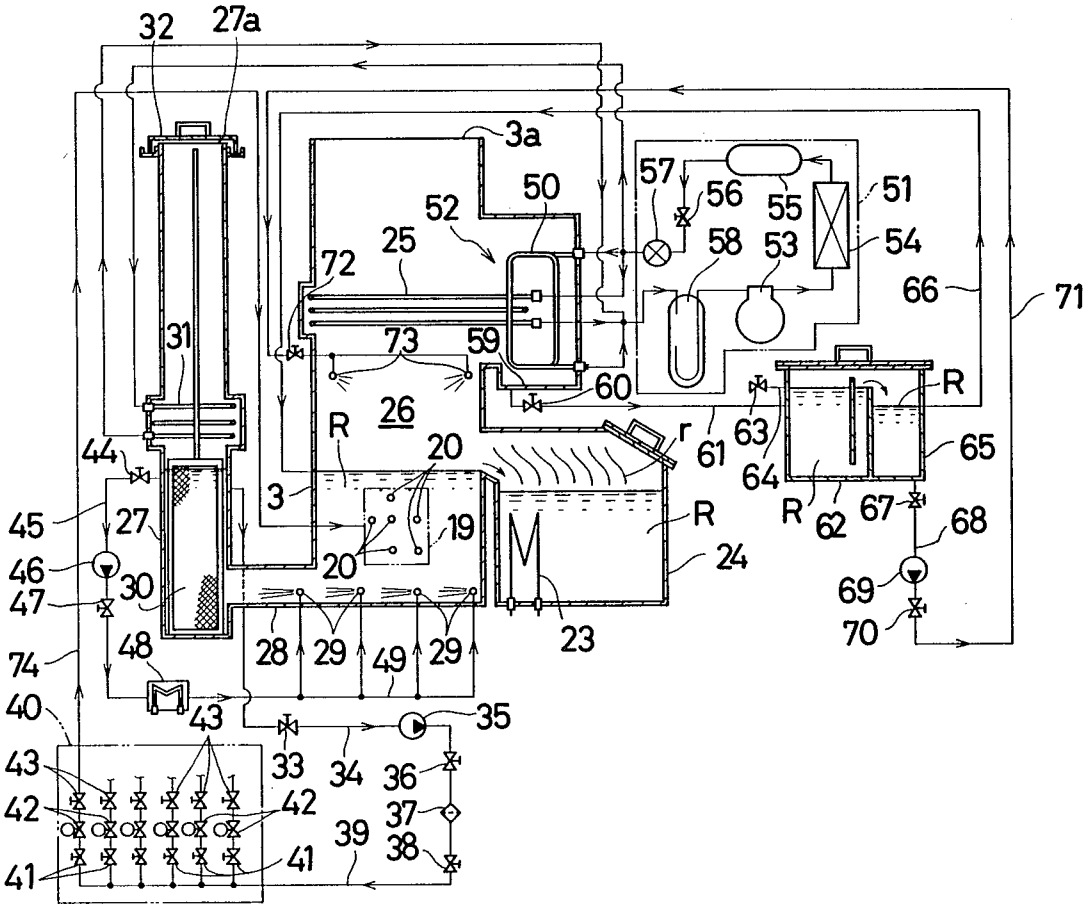
FIG. 4 is a system diagram of the immersion cleaning apparatus.

Referring to FIG. 4, a cutting powder collecting tank 27 is disposed laterally of the cleaning tank 3 for collecting the cutting powder and the like. The powder collecting tank 27 has a bottom communicating with the bottom of the cleaning tank 3 through a cutting powder collecting passage 28. A plurality of cutting powder collecting nozzles 29 are aligned in the collecting passage 28 and the bottom of the cleaning tank 3, and directed toward the powder collecting tank 27.

The powder collecting tank 27 contains a cylindrical filter 30, and a cooling jacket 31 mounted on a lateral inside wall of the collecting tank 27 above the cleaning liquid R in the collecting tank 27. The collecting tank 27 is sealed tight by a lid 32 fitted over a top opening 27*a* thereof.

A first recirculating line 34 is connected to a lateral position of the powder collecting tank 27 through a first valve 33. The first recirculating line 34 extends to a suction end of a liquid jetting pump 35. This pump 35 has a discharge end thereof connected to a second recirculating line 39 including a second valve 36, a filter 39 and a third valve 38. The second recirculating line 39 extends to a jet switching unit 40 including a fourth, a fifth and a sixth valves 41–43 from which liquid delivery lines 74 extend to the liquid supply ports 21 in the cleaning tank 3. These liquid supply ports 21 communicate with the injection nozzles 20 when the support deck 6 is lowered, as noted hereinbefore.

Further, a third recirculating line 45 is connected to another lateral position of the powder collecting tank 27 through a seventh valve 44. The third recirculating line 45 extends to a suction end of a recirculating pump 46. The pump 46 has a discharge end thereof connected through an eighth valve 47 to a heat exchanger 48.

The heat exchanger 48 maintains the recirculated cleaning liquid R below 20° C., preferably at 10°–15° C. A fourth recirculating line 49 extending downstream from the heat exchanger 48 is branched into plural lines for connection to the powder collecting nozzles 29.

Upwardly of the distilling tank 24 is a cooling coil 50 disposed at a lateral position of the cooling jacket 25 for cooling the chloro-fluoro-carbon vapor $\gamma$ to 12°–0° C., for example.

The cooling jackets 25 and 31 and cooling coil 50 consitute an evaporator 52 of a refrigerator 51 to be described below. The refrigerator 51 may be replaced by a chiller as long as the coil surface temperature is maintained at about 12°–0° C.

The refrigerator 51 uses chloro-fluoro-carbon R-11, R-12 or R-22 as a refrigerant, and provides a refrigerating loop through a compressor 53, a condenser 54, a liquid receiver 55, an electromagnetic valve 56, an expansion valve 57 acting as an expansion mechanism connected to the evaporator 52, and an accumulator 58 disposed between the evaporator 52 and the compressor 53.

The chloro-fluoro-carbon liquid R cooled by the cooling coil 50 is allowed to drip to a drip vessel 59 disposed under the coil 50. A fifth recirculating line 61 is connected to a bottom position of the drip vessel 59 through a ninth valve 60. The fifith recirculating line 61 extends to a water separating tank 62.

In the water separating tank 62 water, which is lighter than chloro-fluoro-carbon liquid R, floats on top of the liquid R and is periodically discharged into a drain line 64 connected to a lateral position of the separating tank 62 through a tenth valve 63. The chloro-fluoro-carbon liquid R collected in the separating tank 62 is allowed to overflow into a backup tank 65 to be stored therein. Part of the liquid R is returned to the cleaning tank 3 by way of a sixth recirculating line 66 connected to a lateral position of the backup tank 65. The liquid R in the cleaning tank 3 is allowed to overflow into the distilling tank 24.

Furthermore, a seventh recirculating line 68 is connected to a bottom position of the backup tank 65 through an eleventh valve 67. The seventh recirculating line 68 extends to a suction end of a recirculating pump 69. The recirculating pump 69 has a discharge end thereof connected to an eighth recirculating line 71 through a twelfth valve 70. The eighth recirculating line 71 is connected through a thirteenth valve 72 to finish cleaning nozzles 73 disposed in a vapor cleaning position in the vapor layer 26.

Figure 8:
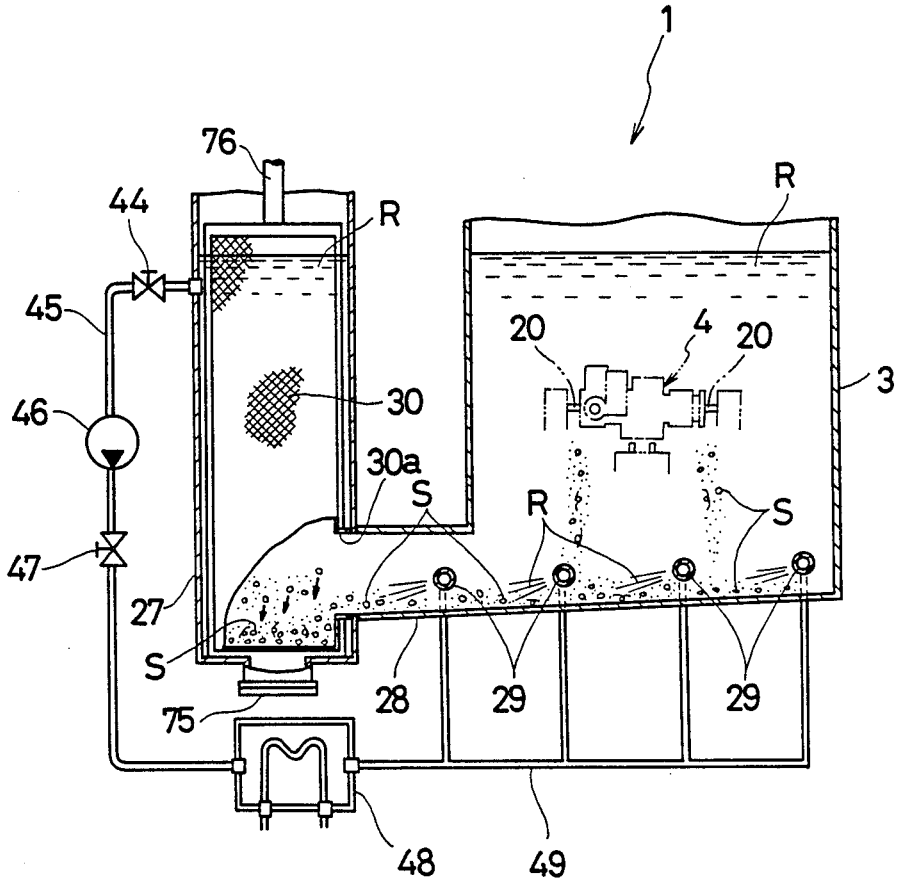
FIG. 8 is an enlarged sectional view of a portion of the apparatus shown in FIG. 4.

Referring to FIG. 8, the bottom of the powder collecting tank 27 is located at a slightly lower level than the bottom of the cleaning tank 3, for collecting impurities S such as cutting powder, burs and like sediments resulting from a cleaning operation. The collecting tank 27 communicates with the cleaning tank 3 through the powder collecting passage 28 which is inclined to allow the impurities S to flow downward from the bottom of the cleaning tank 3 to the bottom of the collecting tank 27. The bottom of the cleaning tank 3 is also inclined to allow the descending impurities S to flow toward the collecting tank 27.

The injection nozzles 29 are arranged in a plurality of rows in the collecting passage 28 and in the bottom of cleaning tank 3 for jetting the liquid downwardly toward the powder collecting tank 27.

The powder collecting tank 27 has the cylindrical mesh filter 30 immersed in the cleaning liquid R. The filter 30 defines a collecting opening 30*a* in a lower lateral position thereof for communication with the collecting passage 28.

A lid 75 is removably attached to a bottom center position of the collecting tank 27. Further, a grip bar 76 extends upward from a top center position of the filter 30 so that the filter 30 is removable from the collecting tank 27 for disposal of the impurities S settled to the bottom of the filter 30 or for change of the filter 30.

How the illustrated embodiment operates will be described hereinafter.

The workpiece 4 is first set to the support deck 6 as shown in FIG. 2 while the support deck 6 stays still in the workpiece setting position $\beta$ above the cleaning tank 3 as shown in FIG. 1. Then the workpiece feeding device 5 is driven to lower the support deck 6 and immerse the entire workpiece 4 in the cleaning liquid R in the cleaning tank 3. At the same time the coupling ports 22 in the bottom of the support deck 6 are connected to the liquid supply ports 21 in the bottom of the cleaning tank 3 as shown in FIG. 3.

Next, the liquid jetting pump 35 shown in FIG. 4 is driven to deliver the cleaning liquid R taken out of the powder collecting tank 27 to the liquid supply ports 21 through the second recirculating line 39, jet switching unit 40 and liquid delivery lines 74, whereby the cleaning liquid R is delivered under pressure to the respective liquid holders 19 of the support deck 6.

The cleaning liquid R delivered to the liquid holders 19 jets under pressure out of the injection nozzles 20 opposed to the parts of the workpiece 4 to be cleaned, to clean these parts of the workpiece 4 mounted on the support deck 6.

For example, as shown in FIG. 5, the cleaning liquid R jets into a tapped hole 4*a* of the workpiece 4 from an adjacent position. Then the cleaning liquid R of chloro-fluoro-carbon having weak surface tension permeates into fine interstices between the tapped hole 4*a* and cutting powder or the like and degreases the abrasive material and the like clinging to surfaces of the tapped hole 4*a* to place them in a readily separable state. Also the specific gravity of the cleaning liquid R is utilized to apply impacts and vibrations to the cutting powder and the like with jets of the cleaning liquid R. This enables the cutting powder and the like persistently clinging to the tapped hole 4*a* to be separated and removed from the tapped hole 4*a* with ease.

Figure 6:
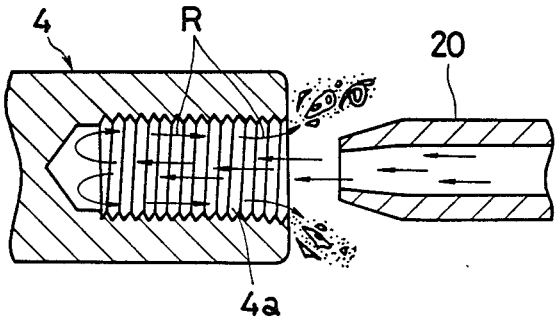

Readily pealable burs and the like remaining inside the tapped hole 4*a* are also separated by the jets of the cleaning liquid R and, as shown in FIG. 6, are driven by the jets out of the tapped hole 4*a* along with the cutting powder.

Thereafter the jet switching unit 40 is operated to successively deliver the cleaning liquid R to the injection nozzles 20 opposed to different sides of the workpiece 4 to carry out the cleaning operation for one side of the workpiece 4 after another.

Figure 7:
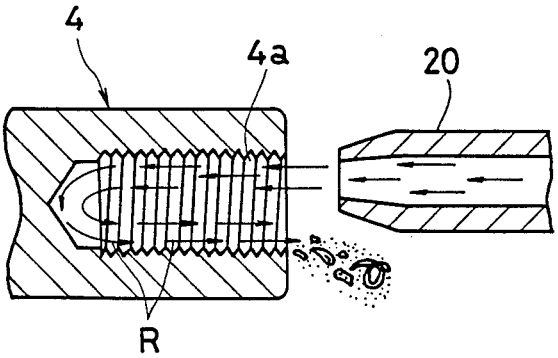

Even where the tapped hole 4*a* is slightly displaced from the jetting position of the injection nozzle 20, the cleaning liquid R may still be directed inwardly of the tapped hole 4*a* as shown in FIG. 7. In this situation, the cleaning liquid R jetting out of the injection nozzle 20 shoots in one direction inside the tapped hole 4*a* and removes the clinging powder and the like from inside the tapped hole 4*a*.

After the immersion cleaning operation, the workpiece feeding device 5 is driven to raise the support deck 6 from the workpiece cleaning position $\alpha$. In the course of ascent, the workpiece 4 mounted on the support deck 6 passes through the chloro-fluoro-carbon vapor $\gamma$ supplied to the vapor layer 26 to undergo vapor cleaning. The workpiece 4 is also exposed to the cleaning liquid R jetting out of the finish cleaning nozzles 73 to wash away cutting powder and the like adhering to outer surfaces of the workpiece 4.

Next, the support deck 6 is stopped at the workpiece setting position $\beta$ above the cleaning tank 3 as shown in FIG. 1. Then the vibrating air cylinder 18 is driven to vibrate the support deck 6, whereby the cleaning liquid R remaining on the workpiece 4 and the support deck 6 is shaken off and dropped to the cleaning tank 3. The cleaned workpiece 4 is transferred to a subsequent process.

Since the workpiece 4 is cleaned as immersed in the cleaning liquid R as described above, the cleaning liquid R jetting out of each injection nozzle 20 is maintained by the surrounding liquid at a temperature for allowing the cleaning liquid R to remain in liquid state without becoming dispersed. The cleaning liquid R in jet streams concentrates on the parts of the workpiece 4 to be cleaned such as tapped holes 4*a*. Consequently, consumption and loss of the cleaning liquid R are minimized during the cleaning operation. The jets of cleaning liquid R apply impacts and vibrations to the cutting powder and the like clinging to the workpiece 4. Thus a very efficient cleaning operation is carried out for positively separating and removing the cutting powder clinging to the workpiece 4 and burs and the like remaining in the tapped holes.

After the impurities S such as burs are separated and removed, the recirculating pump 46 is driven to jet the cleaing liquid R out of the injection nozzles 29 arranged in the bottom of the cleaning tank 3 and collecting passage 28. Then the specific gravity of the cleaning liquid R comprising chloro-fluoro-carbon is utilized to lift the metallic cutting powder and burs relatively easily. Without applying strong jet streams to the impurities S settling to the bottom of the cleaning tank 3, the impurities S may readily be moved down the inclined bottom of the cleaning tank 3 and the collecting passage 28 into the filter 30 in the powder collecting tank 27.

The impurities S such as cutting powder and burs transferred to the collecting tank 27 are accelerated when passing through the narrow collecting passage 28, and are released into an open space in the collecting tank 27. Consequently, the jets become dispersed to lose some of their transporting effect, whereby the impurities S stall and settle to the bottom of the filter 30 to be collected. The suction of the recirculating pump 46 draws the clean liquid R having passed through upper lateral positions of the filter 30, and the pump 46 delivers the clean liquid R to the injection nozzles 29 by way of the recirculating lines 45 and 49.

The impurities S such as cutting powder and burs resulting from the cleaning operation are caused to stall and settle to the bottom of the filter 30 placed in the collecting tank 27. Thus, the collected impurities S are prevented from clogging the entire lateral faces of the filter 30, and the clean liquid R may be recovered from the collecting tank 27 after having passed through the upper lateral positions of the filter 30.

The cleaning liquid R jetting out of each injection nozzle 29 in a constant amount all the time positively transfers impurities S descending to the bottom of the cleaning tank 3 to the collecting tank 27 to be collected. Consequently, the cleaning liquid R supplied to the bottom and inside of the cleaning tank 3 is maintained in a clean state suited for cleaning the workpiece 4 all the time.

This invention is not limited to the described embodiment. For example, the cleaning liquid R may be jetted out against the workpiece 4 successively while the workpiece 4 is temporarily stopped at or may be moved through the workpiece cleaning position $\alpha$ opposed to the jetting positions of the injection nozzles 20 placed in the cleaning liquid R in the cleaning tank 3.

I claim:

1. A chloro-fluoro-carbon liquid jetting immersion cleaning apparatus for cleaning residue material contained on and in a plurality of holes as a result of formation thereof during working of a work piece while being immersed in said liquid, said apparatus comprising a substantially gas tight cleaning tank for storing a preddetermined amount of chloro-fluoro-carbon cleaning fluid therein;

a holder means for holding a work piece to be cleaned, said holder means comprising a plurality of jetting means for jetting said liquid against said holes of said work piece to clean said residue material from said holes, wherein the number of jetting means corresponds to the number of said holes in said work piece and are located to be adjacent said holes so that said liquid is jetted into the respective holes, and wherein said jetting means are disposed so that at least one jetting means jets said liquid vertically and at least one jetting means jets said liquid horizontally;

means for vertically moving said holder means to a non-immersed position above said liquid in said tank and to an immersed position within said liquid in said tank;

means for vibrating said holder means in said non-immersed position to remove residue material and liquid remaining on said work piece after the jetting action in said immersed position; and a plurality of nozzle means located at a bottom of said cleaning tank and connectable to said plurality of jetting means of said holder means so that said cleaning liquid is jetting under pressure against said holes of said work piece when the work piece and holder means are both immersed in said liquid and while said work piece is being held by said holder means.

2. A chloro-fluoro-carbon liquid jetting immersion cleaning apparatus for cleaning a work piece while being immersed in said liquid, said apparatus comprising a cleaning tank for storing a predetermined amount of chloro-fluoro-carbon cleaning liquid therein, said cleaning tank having an inclined bottom;

means for holding a work piece to be cleaned, said holder means comprising jetting means for jetting said liquid against parts of said work piece to clean said parts;

means for vertically moving said holder means to a non-immersed position above said liquid in said cleaning tank and to an immersed position within said liquid in said cleaning tank;

means for vibrating said holder means in said non-immersed position to remove residue material and liquid remaining on said work piece after the jetting action in said immersed position;

first nozzle means located at said bottom of said cleaning tank and connectable to said jetting means of said holder means so that said cleaning liquid is jetted under pressure against said parts of said work piece when the work piece and holder means are both immersed in said liquid and while said work piece is held by said holder means a collecting tank disposed adjacent to said cleaning tank for collecting impurities at a bottom thereof;

a filter disposed within said collecting tank;

a collecting passageway interconnecting the bottom of said cleaning tank and the bottom of said collecting tank so that the lowest portion of the inclined bottom of said cleaning tank is closest to the bottom of said collecting tank so that the impurities at the bottom of said cleaning tank will tend to flow toward the bottom of said collecting tank through said collecting passageway;

second nozzle means disposed at the bottom of said cleaning tank for causing the impurities at the bottom of said cleaning tank to move through said collecting passageway into said collecting tank; and recirculating means for causing the liquid in said collecting tank to pass through the filter with the residue of impurities being filtered therefrom and then recirculated for use in the cleaning tank.

* * * * *